United States Patent [19]

Reese et al.

[11] 4,293,529

[45] Oct. 6, 1981

[54] PROCESS FOR RECOVERING URANIUM FROM WET-PROCESS PHOSPHORIC ACID USING ALKYL PYROPHOSPHORIC ACID EXTRACTANTS

[75] Inventors: Stanton L. Reese; William E. Schroeder, both of Lakeland, Fla.

[73] Assignee: Uranium Recovery Corporation, Mulberry, Fla.

[21] Appl. No.: 955,340

[22] Filed: Oct. 27, 1978

[51] Int. Cl.[3] ..... C01G 43/00

[52] U.S. Cl. ..... 423/10; 423/18

[58] Field of Search ..... 423/10, 18

[56] References Cited

U.S. PATENT DOCUMENTS

| | | | |
|---|---|---|---|
| 2,859,092 | 11/1958 | Bailes et al. | 423/10 |
| 2,866,680 | 12/1958 | Long | 423/10 |
| 2,947,774 | 8/1960 | Levine et al. | 423/10 |
| 3,835,214 | 9/1974 | Hurst et al. | 423/10 |
| 3,987,145 | 10/1976 | Bruns et al. | 423/10 |
| 4,087,512 | 5/1978 | Reese et al. | 423/321 R |

OTHER PUBLICATIONS

Ellis, Dow Report 81, "Recovery of Uranium from Industrial Phosphoric Acids by Solvent Extraction", AEC, Contract #AT-30-1-GEN-236 (1952).

Cronan, *Chem. Eng.,* May 4, 1959, pp. 108-111.

*Industrial & Eng. Chem,* p. 630, Plant Process Series Flowsheet, 1959.

*Primary Examiner*—Edward A. Miller

*Attorney, Agent, or Firm*—Fleit & Jacobson

[57] ABSTRACT

A process is described for the recovery of uranium values from phosphoric acid utilizing an alkyl pyrophosphoric acid (APPA) primary extractant. After extracting the uranium from the phosphoric acid, the APPA extractant is deactivated by heating and the uranium values stripped into a phosphoric acid strip solution containing ferric ion as a salting agent. The uranium values may then be re-extracted directly from this stripping solution without adjustment of its concentration into a dialkyl phosphoric acid trialkyl phosphine oxide synergistic extractant from which a relatively pure yellow cake is precipitated. A new procedure for preparing the requisite APPA primary extractants is also disclosed.

22 Claims, 2 Drawing Figures

PROCESS FOR RECOVERING URANIUM FROM WET-PROCESS PHOSPHORIC ACID USING ALKYL PYROPHOSPHORIC ACID EXTRACTANTS

FIELD OF THE INVENTION

This invention relates to the recovery of uranium from "wet process" phosphoric acid which is an intermediate in the conversion of phosphate rock to certain fertilizers.

BACKGROUND OF THE INVENTION

Mineable phosphate is found in a number of places throughout the world, and in many of these deposits, small quantities of uranium are found complexed with the phosphate values. The large phosphate deposit in Central Florida, for example, contains from 0.01 to 0.02 weight percent uranium. This uranium is taken into solution when the phosphate is acidulated with mineral acid to produce what is known as "wet process" phosphoric acid. It is estimated that over six million pounds of uranium, expressed as $U_3O_8$, is now dissolved each year in the United States in the production of wet process phosphoric acid. Uranium is a valuable energy resource and is used as fuel in nuclear power reactors.

Interest in recovering uranium from wet process phosphoric acid arose about three decades ago when the then U.S. Atomic Energy Commission was searching for a domestic supply of uranium for nuclear weapons use. This early work is described in a publication of the U.S. Atomic Energy Commission known as DOW-81 and entitled "The Recovery of Uranium from Industrial Phosphoric Acids by Solvent Extraction". Alkyl pyrophosphoric acids (APPA) were found to be very efficient in selectively extracting uranium from phosphoric acid and several flow sheets utilizing this type extractant are shown in U.S. Pat. No. 2,866,680, to Ray S. Long. Although this type extractant has a very high distribution coefficient for uranium, in favor of the extractant, upon contacting with wet process phosphoric acid when the uranium and iron in the acid are in their lower valence states, the coefficient is still substantial even when the uranium and iron in the phosphoric acid are in their oxidized states. It even continues to be well above one ($E_a^\circ = 1$) when contacted with concentrated phosphoric acid, a potential stripping agent from which, after dilution, the uranium could be reextracted for further purification. Therefore, prior processes using a pyrophosphoric acid extractant, such as disclosed in the prior Long patent, were forced to rely upon precipitation as the means of separating the uranium from the extractant. The resulting product was impure, requiring redissolution and further purification before it could be put to use. Another disadvantage of the APPA extractant as used in prior methods is that it is not stable and, thus, requires continual regeneration with phosphoric oxide.

In view of these disadvantages, work continued in an effort to find a more stable extractant and one that produced a more pure uranium precipitate. This work resulted in the discovery of a synergistic mixture of di-2-ethylhexyl phosphoric acid (D2EHPA) and trioctyl phosphine oxide (TOPO), which was specific for uranium in the hexavalent state and which was quite stable. A process utilizing the D2EHPA-TOPO extractant was developed at Oak Ridge National Laboratory and is described in a U.S. Atomic Energy Commission report ORNL-TM-2522, entitled "Solvent Extraction of Wet-Process Phosphoric Acid". More recently, octylphenyl acid phosphates (OPAP) were found to have good extraction characteristics for uranium in the tetravalent state in wet process phosphoric acid. This work was originally performed in India by T. K. S. Murthy et al and is described in IAEA-SM-135/11, "Study of Some Phenyl Phosphoric Acids for Extraction of Uranium from Phosphoric Acids", an International Atomic Energy Agency report of papers presented in Brazil in 1970. This extractant was tested at the Oak Ridge National Laboratory and is the subject of U.S. Pat. No. 3,835,214 to Hurst et al. The distribution coefficient ($E_a^\circ$) with octylphenyl acid phosphates in reduced acid is about twice that of the D2EHPA-TOPO extractant of equal concentration in oxidized acid, and it is relatively stable, but its distribution coefficient is only one-twentieth of the distribution coefficient of APPA for uranium under the same conditions. However, wet process phosphoric acid from Central Florida has the general composition shown in the following table, Table I, and certain components of commercial OPAP are found to form a complex with the iron in the acid, and the extractant is thus lost as a precipitate.

TYPICAL COMPOSITION

| WET PROCESS PHOSPHORIC ACID FROM CENTRAL FLORIDA ROCK | |
|---|---|
| COMPONENT | NOMIMAL WEIGHT PERCENTAGE CONTAINED |
| $H_3PO_4$ | 40 |
| Al | 0.45 |
| Ca | 0.30 |
| Cl | 0.00 |
| Fe | 0.75 |
| F | 1.6 |
| K | 0.05 |
| Mg | 0.18 |
| Mo | 0.001 |
| Na | 0.1 |
| Si | 0.4 |
| $SO_4$ | 2.5 |
| U | 0.017 |
| Inorganic Solids | 2.0 |
| Organic Solids (humates) | 1.0 |
| EMF | −300 mv |

A serious drawback found in both of the more stable extractants D2EHPA-TOPO and OPAP arises from the fact that their distribution coefficients may decrease by as much as 50% or more after extended use in a uranium recovery process. Possible causes of this loss are from flotation additives used in rock beneficiation, from foam depressants used in acid manufacture, and from additives used to settle out solids when the acid is clarified. Minor metallic impurities in the starting acid, such as vanadium, may also be taken up by the extractant and lessen its affinity for uranium. The number of possible inhibiting additives are many and, although they may be present as only a few parts per million, they have been found to increase in concentration upon repeated cycling of the extractant with a corresponding increase in effect upon the extractant's long term performance until the point is reached where it must be replaced. Further, we have also found that losses of these extractants by entrainment in the acid and from solids separation can approach as much as two percent of the extractant during each cycle. This amounts to a substantial cost, since these two more stable extractants are relatively expensive. An important advantage of the process of this invention is that only a small quantity of APPA is needed in the recovery process in view of its high extraction coefficient, and the quantity of APPA necessary is about equal to ordinary losses of the D2EHPA-TOPO and OPAP extractants used in the other known processes.

SUMMARY AND BRIEF DESCRIPTION OF THE INVENTION AND ITS SALIENT FEATURES

Our invention comprises as its basic feature a method for stripping uranium from an extractant of the alkyl pyrophosphoric acid type (APPA) into an aqueous phosphoric acid solution from which the uranium is readily re-extracted for further purification and precipitation as high purity yellow cake, thus permitting the use of this relatively inexpensive extractant in a practical process for recovering uranium from wet process phosphoric acid. Hence, by our method, an APPA extractant, which is highly efficient even with the more concentrated wet process phosphoric acid produced by the more advanced processes, can be used without intermediate precipitation and redissolution steps in a process for recovering a uranium product of commercial purity.

More specifically, we have discovered that, after loading an APPA extractant with uranium by extraction from wet process phosphoric acid, if the loaded extractant is heated at a temperature of about 70° C. to about 140° C. for a period of from about one-half hour to about six hours the distribution coefficient of the APPA extractant for uranium in phosphoric acid is lowered by a factor of from 4 to 10, or possibly more, where it there levels off. Thus, without expensive or lengthy treatment, it becomes possible to achieve a practical stripping of the uranium from the extractant using a phosphoric acid stripping solution by reason of the change in the extractant's distribution coefficient. Further, since APPA type extractants are not particularly sensitive to phosphoric acid concentrations, our invention can be used to extract uranium values from wet process phosphoric acid having concentrations of as low as 25% $H_3PO_4$ by weight to as high as 55% $H_3PO_4$ by weight. Suitable phosphoric acid strip solutions can have acid concentrations in the range of 25% to 85% by weight $H_3PO_4$, but a concentration in the range of 35% to 55% by weight $H_3PO_4$ is more desirable and about 40% by weight $H_3PO_4$ is preferred.

The various APPA extractants that can be used in our invention are those disclosed in U.S. Pat. No. 2,866,680 and include those in which the substituent alcohol has a chain length of from 7 carbon atoms to 17 carbon atoms. We prefer alcohols containing 8 to 10 carbon atoms.

In view of the high distribution coefficient ($E_a°$) of the APPA extractants for uranium in phosphoric acid, only a small quantity is necessary in accordance with our invention. An organic diluent containing 0.5% to 5.0% by weight APPA can be used with 1.0 to 2.5% more desirable and about 2% preferred. Further, when treating more concentrated phosphoric acid starting solutions (near 55% $H_3PO_4$ by weight), and depending upon cost considerations of reagent materials, it may be desirable to use higher than 5% APPA solutions, even up to 10%. Kerosene and Stoddard solvents have been found to be excellent solvents for use as a diluent with these alkyl pyrophosphoric acid extractants. However, many other materials are satisfactory including petroleum materials such as diesel oil, aromatic oils, distillates, various commercial organic solvents, and petroleum ethers. Benzene, chlorobenzene, toluene, hexane, chlorinated aliphatic hydrocarbons, and ethers are also suitable with the selection of any particular solvent being made generally on the basis of economic considerations. Refined kerosene is presently considered the preferred.

Further, we have discovered that if a small amount of ferric ion, in the range of about 0.1% to 1.5% by weight, preferably 0.25 to 1.0%, is present in the phosphoric acid stripping reagent when contacting the pregnant APPA extractant, stripping of the uranium is enhanced by a factor of 10 or more. Thus, we have found in accordance with our invention that by heat treating the pregnant APPA extractant and stripping with a phosphoric acid strip solution containing 0.1 to 1.5% by weight ferric ion, it is possible to produce an overall distribution coefficient for stripping of uranium from the loaded APPA extractant in the neighborhood of 0.2–0.3 ($E_a°=0.2$ to 0.3) or less. Accordingly, nearly complete stripping of the uranium from the APPA extractant can be accomplished and the uranium transferred directly into a phosphoric acid solution from which it can then be re-extracted without dilution for recovery. For example, the uranium can be re-extracted from the phosphoric acid strip solution into an extractant such as a D2EHPA-TOPO synergistic mixture, from which a uranium product of high purity can be precipitated. Such direct re-extraction has the advantage of avoiding the cost of reconcentrating the strip acid before it can be reused.

Furthermore, we have found it advantageous to add a small amount of oxidizing agent, such as hydrogen peroxide, sodium chlorate, potassium permanganate, or the like, to the loaded APPA extractant. By the addition of such oxidant, the uranium stripping from the APPA by the phosphoric acid strip solution is further improved by a factor of 2 to 3. The quantity of oxidizing agent added should be sufficient to oxidize all of the uranium and iron ions contained in the extractant to their +6 and +3 states, respectively.

PREPARATION OF THE ALKYL PYROPHOSPHORIC ACID EXTRACTANT

While the preparation procedure described in Long U.S. Pat. No. 2,866,860 for preparation of the APPA extractants is suitable for the present invention, we have discovered surprisingly that preparation of the alkyl pyrophosphoric acid solution at a high reaction temperature, about 80° C. to 140° C., in the absence of excessive moisture, results in a clear extractant solution that remains stable far longer than similar extractants described by Long. More specifically, we have found that if the alcohol (ROH), such as octyl or decyl alcohol, is reacted with the phosphoric oxide ($P_4O_{10}$) which has been slurried in an organic diluent, such as refined kerosene, at a high reaction temperature of about 80° C. to 140° C., preferably 85° to 100° C., in the absence of excessive moisture, an alkyl pyrophosphoric acid solution results which is clear and remains stable far longer than indicated by Long in U.S. Pat. No. 2,866,680. The stability was determined by the distribution coefficient of the extractants remaining essentially constant for at least three weeks when stored in an ordinary, opaque, storage tank at ambient temperatures.

In preparing APPA extractants in accordance with our invention, we prefer a mole ratio of about four, alcohol to phosphoric oxide ($ROH:P_4O_{10}=4$); however, the mole ratio may deviate slightly from the preferred. Suitable organic diluents in which the phosphoric oxide is slurried are kerosene, benzene and ether and the oxide concentration is preferably 0.1 to 0.2 grams $P_4O_{10}$ per ml. of diluent. Since the APPA extractants used to recover uranium in accordance with this invention are dissolved in a substantial quantity of organic diluent, it is preferable to slurry the phosphoric oxide for preparation of the APPA extractant in the same organic diluent that is to be used to dilute the APPA extractant for the uranium recovery. Refined kerosene has been found most suitable. The reaction time is quite short; the reaction going to completion usually is less than about 30 minutes.

APPA extractants produced in accordance with the above description appear to have considerably improved storage characteristics compared to those previously produced and described by Long in U.S. Pat. No. 2,866,680, thus permitting the preparation of larger and more economic batches. This extractant can therefore be fed continuously into the process without fear of loss of extraction capability while in the feed tank or loss of usefulness from long standing during plant outages. Further, we have determined that when an APPA extractant prepared in accordance with the above procedures is introduced directly into the extraction contactor circuit at normal wet process phosphoric acid temperatures of about 50° C. to 60° C., it is sufficiently stable to perform effectively through at least four contact stages, thus permitting recoveries well in excess of 90% of the uranium originally contained in the wet process acid. Hence, it is possible with the APPA extractants to extract the uranium from the wet process phosphoric acid without the expense of artificially cooling the acid before extraction as previously practiced, or reheating the acid which must be done for it to proceed on its way to becoming a product of commerce.

DETAILED DESCRIPTION OF A TYPICAL FLOW SHEET OF THE INVENTION

Wet process phosphoric acid having an analysis as set forth in Table I is first treated to remove the organic solids, such as by the process described in U.S. Pat. No. 4,087,512. The cleaned acid is then contacted with a reducing agent, as at 101, such as scrap iron or ferrosilicon or other known reductant which, as it dissolves in the acid, reduces any $U^{+6}$ to $U^{+4}$ and reduces $Fe^{+3}$ to $Fe^{+2}$. As is apparent from the references previously cited, it is not necessary that all of the $Fe^{+3}$ be reduced to the lower valence state in order to effectively extract the uranium from wet process acid. In fact, an advantage of the instant process is that extractant concentration may be varied to offset consumption of reductant by operating with more or less $Fe^{+3}$ present as their relative costs dictate and without loss of extraction efficiency.

The cleaned and reduced wet process acid in an concentration range of 25% to 55% $H_3PO_4$ by weight is introduced into a countercurrent liquid-liquid solvent extraction system 103 where it is contacted with an organic diluent, such as refined kerosene, to which about 2% APPA by weight is added as it enters the system at 106. At this concentration of APPA, the distribution coefficient ranges from 20 to 30 ($E_a^\circ=20$ to 30) when contacted with wet process acid at its normal temperature of about 55° C. and in which 80% to 90% of the iron content has been reduced to the ferrous state, the coefficient being highest in the first contactor and the lowest after final contact with the acid. A distribution coefficient of this magnitude has a number of advantages, some of which include: (1) a small volume of organic may be used compared to the volume of acid contacted, thus smaller, less costly equipment is required for downstream processing of the pregnant organic; (2) a large concentrating effect on the uranium is obtained; and (3) fewer extraction stages are required to obtain good recovery. While four stages of extraction are shown and preferred, as few as two or as many as ten might be used depending upon a number of factors, such as the concentration of the APPA in the organic diluent.

Figure 1A:
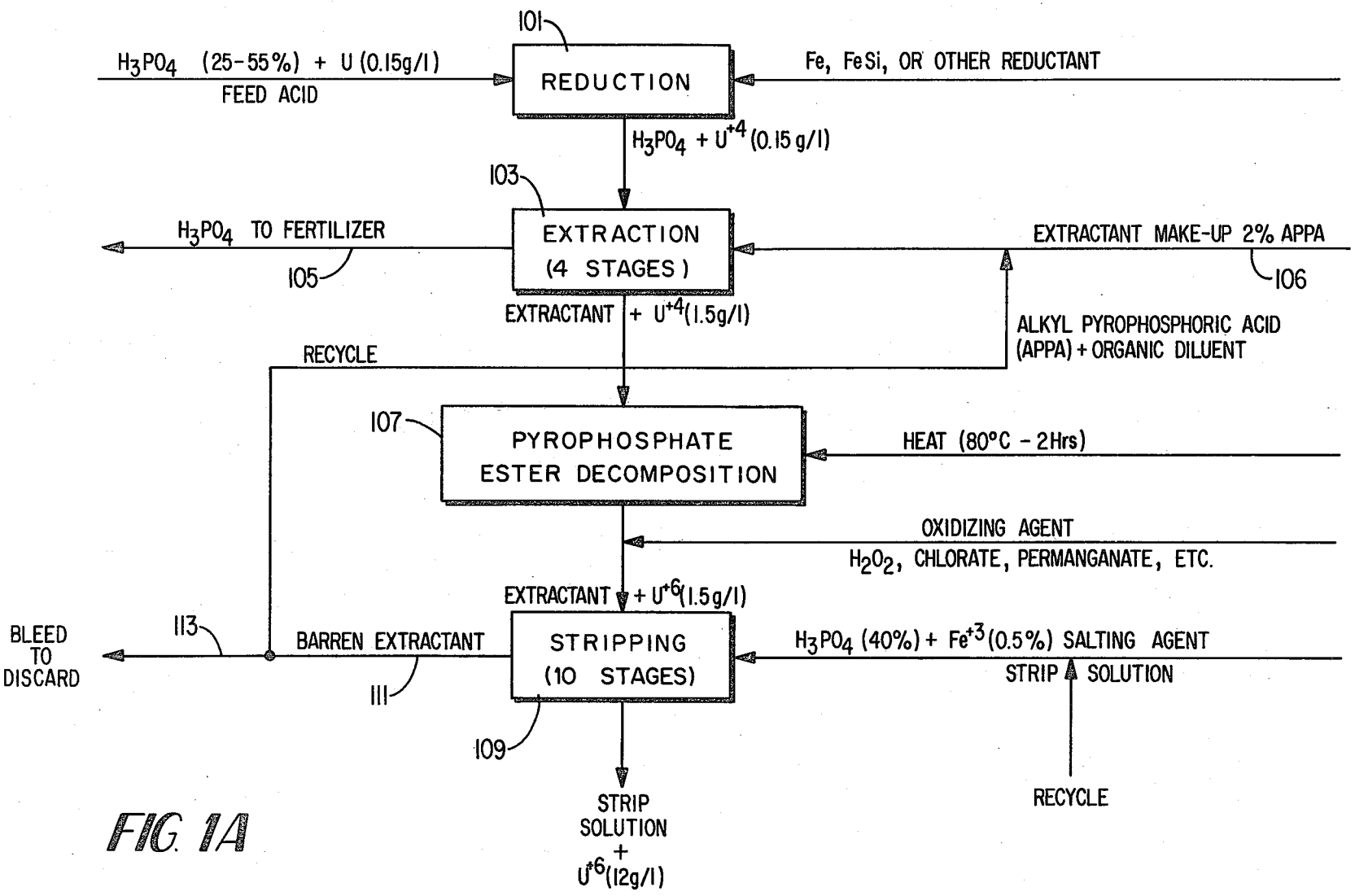
FIGS. 1A and 1B show a typical flow sheet for the recovery or uranium in accordance with the present invention where like numerals are referred to hereinafter.
Figure 1B:
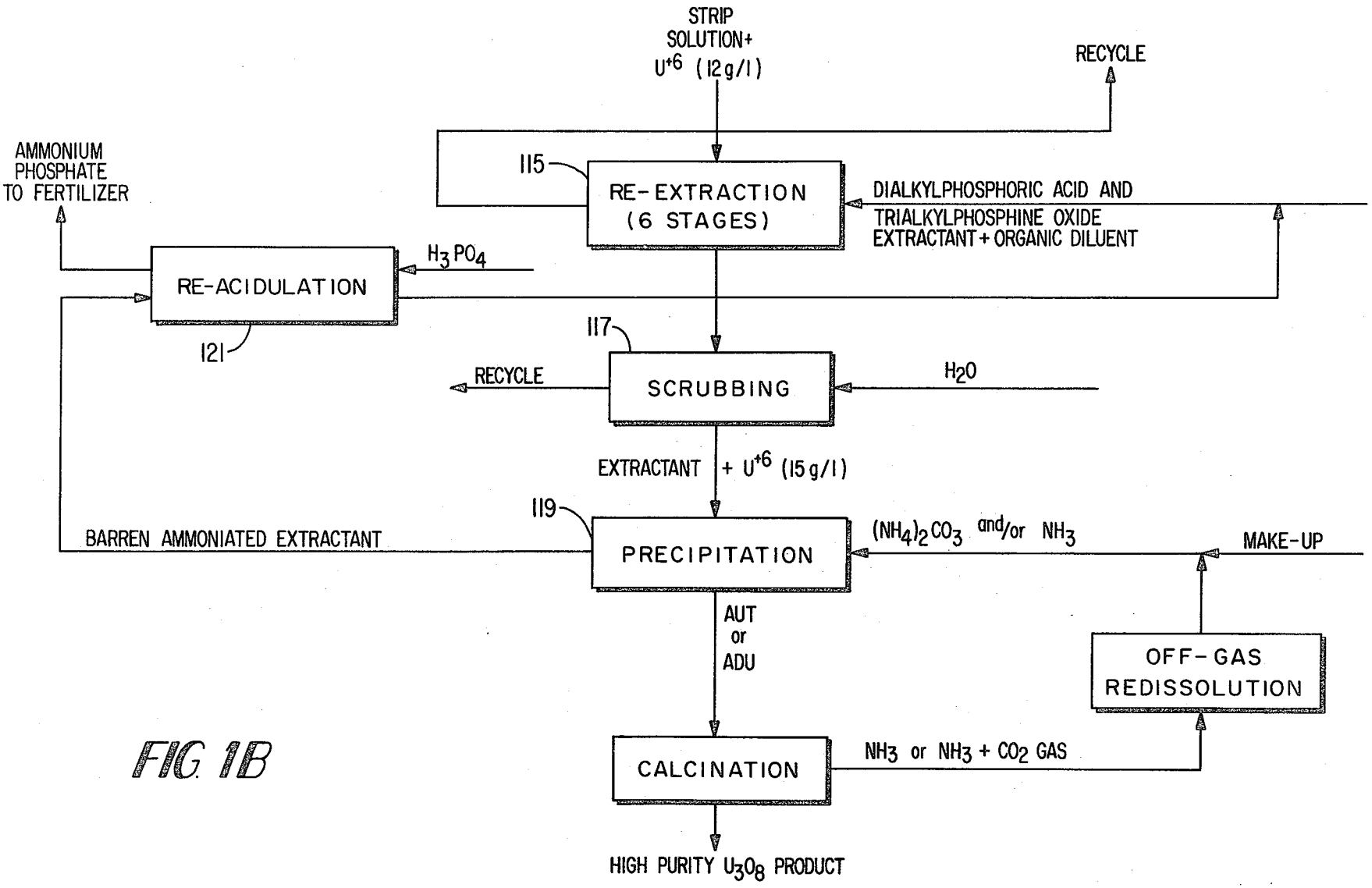

The process in FIG. 1 also contemplates an aqueous to organic ratio of ten (A:0=10). However, ratios in the range of about 1:1 to 20:1 can be employed. It will be appreciated that concentrations of the extractant in the organic phase and the phase ratio are interrelated and that the particular choice of values for these variables will depend on a variety of factors including solubilities of the relevant materials. A uranium concentration in the organic of about 1.5 grams per liter compared to about 0.15 grams per liter in the acid when using four contact stages will achieve a recovery of 96% of the uranium in the feed acid.

Following extraction of the uranium, the wet process acid is returned to the acid plant for further processing as shown by line 105. The organic is then heated at a temperature of about 80° C. for about one hour at 107. After such heat treatment, the distribution coefficient drops and levels out in the range of 3 to 5 ($E_a^\circ=3$ to 5) for acid concentrations of about 40% $H_3PO_4$ by weight. A small quantity of oxidizing agent, such as hydrogen peroxide, chlorate ion (sodium chlorate), permanganate ion (potassium permanganate), or other known oxidizing agent, is then added to oxidize the uranium and iron ion content of the extractant to hexavalent uranium and ferric iron. The amount of oxidizing agent added should be an excess of the stoichiometric amount required to achieve the desired oxidation. A 50% by weight solution of $H_2O_2$ is suitable and an addition of about 0.1% by volume of extractant should accomplish the requisite oxidation in the process shown in FIG. 1. The oxidation further depresses the distribution coefficient to about 1 to 2 ($E_a^\circ=1$ to 2). While the oxidizing agent as shown in FIG. 1 is to be added after heating, it is contemplated for our invention that the oxidizing agent may be added during heating, or even before. It is only necessary that it be added before commencing the stripping.

The organic is now ready to be stripped of the uranium. This is accomplished in a countercurrent liquid-liquid system 109, using say 10 contactors which are operated in the range of 60° C. to 70° C. to achieve good phase disengagement and more favorable stripping efficiency. The stripping solution comprises 40% $H_3PO_4$ by weight and contains about 0.5% by weight ferric ion dissolved therein. The ferric ion concentration in the strip solution can be obtained by adding iron metal to the acid in a quantity sufficient to establish the desired ferric concentration. Ferric ion can be added directly by addition of a ferric salt, such as ferric sulfate. Further, since ferric ions are extracted by the APPA extractant from the wet process phosphoric acid, and therefore necessarily will carry over to the strip solution, iron or ferric ion addition is not essential since ferric ion will necessarily build up in the strip solution after a few stripping cycles.

During the stripping, the ferric ion acts to salt the uranium out of the extractant. The distribution coefficient in this system is less than 0.1 ($E_a^\circ=0.1$). All but a few milligrams per liter of the uranium can be removed from the extractant in ten contact stages of this relative small equipment. Again, however, the number of stripping stages can vary from as low as 4 to as many as 12 or more depending upon concentrations, phase ratios, etc. Also, the organic to aqueous ratio in the system shown is about eight (0:A=8), but again can vary. For this system shown in FIG. 1, a uranium concentration of about 12 grams per liter is obtained in the strip solution. The barren extractant 111 is recycled to extraction. It now consists principally of diluent and decomposition products of APPA, believed to be mostly alkyl orthophosphoric acids which themselves have an appreciable distribution coefficient for the $U^{+4}$ in the wet process acid.

While it is not understood precisely how the heat treatment chemically alters the loaded APPA extractant to reduce the distribution coefficient in a phosphoric acid system, it is believed that heating the APPA extractant to about 70° to 140° C. for ½ to 6 hours serves to destroy some of the pyroesters responsible for generating the initial high distribution coefficients of the alkyl pyrophosphoric acids for uranium in phosphoric acid solutions. Heat treatment at temperatures in the lower end of the temperature range requires longer heating times toward the upper end of the time range and, conversely, a higher heating temperature requires less time to achieve the desired reduction of the APPA distribution coefficient. Thus, heat treatment at about 70° C. requires about 4 to 6 hours whereas heating to 130° to 140° C. requires only about ½ hour or less heat treatment. It is believed that heating to about 80° F. and for about 1 hour is the most practical for altering the distribution coefficient of the APPA extractant in accordance with the instant invention.

Experience has shown that extractant losses in the commercial separation of uranium from wet process acid due to entrainment, solubility in the acid, losses to interface emulsions, etc. is approximately two percent. In this process, the quantity of new APPA added to the extractant solution can be varied by adjusting other parameters somewhat to match losses without lowering uranium yield. A bleed as at 113 is also provided to maintain extractant equilibrium. Spent APPA can be removed from the system by contacting the extractant solution with a phosphoric acid solution, having, for example, a 40% by weight $H_3PO_4$ concentration, which contains an excess of about 1.5% by weight ferric ion. Such an excess ferric ion concentration precipitates an organic-iron complex. This can then be removed from the extractant solution before recycle (not shown), such as by filtration. By relying upon APPA for only one use and then only for a short period which occurs immediately upon its introduction into the extraction system, the long-term effects that lower the distribution coefficient of the stable extractants are avoided.

The strip solution containing about 12 grams of uranium per liter in the example of FIG. 1 is then contacted as at 115 with a synergistic mixture of dialkyl phosphoric acid and trialkyl phosphine oxide in an organic diluent such as refined kerosene as described in ORNL-TM-2522. Six re-extraction stages are sufficient to remove 99% of the uranium into the extractant which is maintained as the continuous phase in the re-extraction system. The high concentration of uranium in the strip solution feed to re-extraction provides sufficient uranium to nearly saturate the extractant with uranium. As it approaches saturation, uranium replaces other metallic species in the extractant, leaving fewer impurities to precipitate with the uranium. The uranium content of the loaded extractant is about 15 grams per liter. Entrained phosphoric acid is next scrubbed out of the extractant, as at 117, to minimize phosphate contamination of the product, and the washed extractant is continuously fed to the precipitation system 119. Here, the extractant is contacted with either ammonium carbonate to precipitate ammonium uranyl tricarbonate (AUT) or ammonia may be used to precipitate ammonium diuranate (ADU). AUT produces a more filterable precipitate under these conditions than does ADU. The precipitate is filtered off, dried and calcined. The yellow cake decomposes to commercially pure $U_3O_8$ and ammonia or ammonia and carbon dioxide gases, which gases are re-dissolved and reused. The ammoniated extractant is reacidulated, as at 121, with mineral acid and recycled to re-extraction.

As is apparent from the description, our discoveries have permitted us to devise a process with many cost saving advantages over the processes previously used to recover uranium from wet process phosphoric acid and to produce a commercially pure uranium oxide product. Other advantages and other systems which may be readily apparent from this disclosure to one skilled in the art are considered to be within the scope of this invention.

We claim:

1. Process for obtaining uranium values from an extractant consisting essentially of an alkyl pyrophosphoric acid dissolved in a water immiscible organic solvent and containing said uranium values, which comprises (1) heating said extractant to lower the distribution coefficient for uranium from phosphoric acid; and (2) stripping said extractant with a phosphoric acid strip solution comprising from about 25 to 80% by weight $H_3PO_4$ and having dissolved therein, prior to stripping, ferric ions in a concentration sufficient to salt uranium out of the extractant into the phosphoric acid solution.

2. Process according to claim 1 which further comprises adding an oxidizing agent to said extractant.

3. Process according to claim 2 wherein the oxidizing agent oxidizes the uranium and iron ions to their +6 and +3 states, respectively.

4. Process according to claim 3 wherein said oxidizing agent is a 50% by weight solution of $H_2O_2$.

5. Process according to claim 1 wherein said strip solution comprises from about 35% to about 55% by weight $H_3PO_4$ and from about 0.1% to about 1.5% by weight ferric ion.

6. Process according to claim 1 wherein said water immiscible organic solvent is refined kerosene.

7. Process according to claim 1 wherein the alkyl pyrophosphoric acid is a reaction product of phosphoric oxide and an alcohol containing 7 to 17 carbon atoms.

8. Process according to claim 7 wherein said alcohol contains 8 to 10 carbon atoms.

9. Process according to claim 1 wherein said extractant is heated in step (1) at a temperature between about 70° C. and about 140° C. for a period of about ½ to about 6 hours.

10. Process according to claim 1 wherein said extractant is heated in step (1) at a temperature of about 70° C. to about 90° C.

11. Process according to claim 1 wherein said extractant is heated in step (1) at a temperature of about 80° C. for a period of about 1 hour.

12. Process according to claim 1 wherein said extractant contains about 0.5% to about 5% by weight alkyl pyrophosphoric acid.

13. Process according to claim 1 wherein said extractant contains about 1.0% to about 2.5% by weight alkyl pyrophosphoric acid.

14. Process according to claim 1 wherein said extractant contains about 2% by weight alkyl pyrophosphoric acid.

15. Process according to claim 1 wherein said alkyl pyrophosphoric acid is prepared by reacting an alcohol with phosphoric oxide, slurried in an organic diluent, at a reaction temperature of about 80° C. to about 140° C., in the absence of excessive moisture, said reactants being at a ratio of one mole alcohol to each atomic weight of phosphorus in said phosphoric oxide.

16. Process for the recovery of uranium values from wet process phosphoric acid which comprises:

(a) extracting uranium values from said acid into an extractant consisting essentially of alkyl pyrophosphoric acid dissolved in an organic diluent;

(b) heat treating said extractant to lower its distribution coefficient for uranium in phosphoric acid;

(c) stripping uranium values from the extractant into a phosphoric acid strip solution containing ferric ion in a concentration sufficient to salt uranium out of the extractant into the phosphoric acid solution; and (d) extracting the pregnant strip solution in a second liquid-liquid solvent extractant cycle after which the uranium values are precipitated from the organic phase.

17. Process according to claim 16 wherein said extractant consists essentially of about 0.5 to 5% by weight alkyl pyrophosphoric acid dissolved in an organic diluent.

18. Process according to claim 16 wherein said wet process phosphoric acid is treated to reduce substantially all of the uranium values to the tetravalent state prior to step (a).

19. Process according to claim 16 wherein said extractant is heat treated in step (b) at a temperature of about 70° C. to about 140° C. for a period of about ½ to about 6 hours.

20. Process according to claim 16 wherein said uranium values are oxidized after step (a) and before step (c) by adding an oxidizing agent to said extractant in order to oxidize the contained uranium and iron ions to their +6 and +3 states, respectively.

21. Process according to claim 16 wherein the extractant from which uranium values have been stripped after step (c) is treated to separate spent alkyl pyrophosphoric acids and their decomposition products therefrom by contacting said extractant with a phosphoric acid solution containing dissolved ferric ion in excess of 1.5% by weight to form a complex of the decomposition products with iron which precipitates.

22. A continuous process for recovering uranium values from wet process phosphoric acid which comprises the steps of (a) extracting the uranium values with an extractant solution comprising alkyl pyrophosphoric acid dissolved in an organic diluent to yield a pregnant solution, (b) heat treating the pregnant extractant solution to lower its distribution coefficient for uranium in phosphoric acid, (c) stripping the uranium values from the pregnant extractant solution into a phosphoric acid strip solution containing ferric ion in a concentration sufficient to salt uranium out of the extractant and into the phosphoric acid solution, (d) recycling barren extractant solution to extracting step (a), and, during recycle, (e) adding a fresh quantity of alkyl pyrophosphoric acid to the barren extractant solution sufficient to accomplish the desired extraction in step (a), after bleeding an essentially equal quantity of barren extractant solution.

* * * * *